US010030955B1

(12) United States Patent
Sapp et al.

(10) Patent No.: US 10,030,955 B1
(45) Date of Patent: Jul. 24, 2018

(54) MULTI-PURPOSE NON-LETHAL BLUNT TRAUMA GRENADE

(71) Applicant: The United States of America as Represented by the Secretary of the Army, Washington, DC (US)

(72) Inventors: Nicole Harasts Sapp, Augusta, NJ (US); Leon Moy, Montclair, NJ (US); Mark Motyka, Cedar Grove, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/281,168

(22) Filed: Sep. 30, 2016

(51) Int. Cl.

| | |
|---|---|
| ***F42B 27/00*** | (2006.01) |
| ***F42B 12/42*** | (2006.01) |
| ***F42B 12/56*** | (2006.01) |
| ***F42B 12/36*** | (2006.01) |
| ***F42B 8/26*** | (2006.01) |
| ***F42C 14/02*** | (2006.01) |

(52) U.S. Cl.
CPC ..... *F42B 27/00* (2013.01); *F42B 8/26* (2013.01); *F42B 12/36* (2013.01); *F42B 12/42* (2013.01); *F42B 12/56* (2013.01); *F42C 14/02* (2013.01)

(58) Field of Classification Search
CPC ..... F42B 27/00; F42B 12/36; F42B 12/42; F42B 12/46; F42B 12/56; F42B 8/26; F42C 14/02
USPC ..... 102/482, 487, 502
See application file for complete search history.

(56) References Cited

U.S. PATENT DOCUMENTS

| | | | | |
|---|---|---|---|---|
| 5,654,523 | A * | 8/1997 | Brunn | F42B 8/26 102/368 |
| 7,354,271 | B2 * | 4/2008 | Brunn | F42B 8/26 434/12 |
| 8,161,883 | B1 * | 4/2012 | Harasts | F41A 33/04 102/361 |
| 9,151,584 | B2 * | 10/2015 | Kapeles | F42B 8/26 |
| 9,470,495 | B2 * | 10/2016 | Kravel | F42B 12/72 |
| 2005/0084827 | A1 * | 4/2005 | Brunn | F42B 8/26 434/12 |
| 2007/0266883 | A1 * | 11/2007 | Law | F42B 12/60 102/482 |
| 2008/0006171 | A1 * | 1/2008 | Confer | F42B 12/08 102/497 |

FOREIGN PATENT DOCUMENTS

| | | | | |
|---|---|---|---|---|
| EP | 2439483 | B1 * | 11/2014 | F42B 12/32 |
| EP | 2650637 | B1 * | 11/2014 | F42B 8/26 |
| WO | WO 9718435 | A1 * | 5/1997 | F42B 8/26 |

* cited by examiner

*Primary Examiner* — James S Bergin
(74) *Attorney, Agent, or Firm* — John P. DiScala

(57) ABSTRACT

A multi-purpose non-lethal blunt trauma grenade which produces both blunt trauma effects as well as light and sound effects. The non-lethal blunt trauma grenade comprises a main charge holder configured for not fragmenting upon ignition of the main charge and which includes a plurality of vent holes sized and oriented to balance the propulsive force of gases generated by a main charge.

13 Claims, 3 Drawing Sheets

MULTI-PURPOSE NON-LETHAL BLUNT TRAUMA GRENADE

The invention described herein may be manufactured, used, and licensed by or for the U.S. Government for U.S. Government purposes.

BACKGROUND OF INVENTION

Field of the Invention

The present invention relates to grenades, and more particularly to non-lethal grenades.

Related Art

Non-lethal grenades have been employed by law enforcement officers and the military for producing a non-lethal explosion to temporarily disorient and/or disable individuals, such as suspects, rioters and combatants. Such effects are critical to facilitate the capture of enemy combatants or to minimize collateral damage; especially, in urban warfare and in hostage rescue operations, where the presence of noncombatants is likely.

Generally, there are two types of non-lethal grenades—blunt trauma grenades and flash bang grenades. Blunt trauma grenades achieve their disabling effect by projecting one or more projectiles at a non-lethal force. For example, the United States Army currently uses blunt trauma grenades designated the XM104 and the M99 to temporarily confuse, disorient, distract or incapacitate enemy combatants or terrorists. Intended for use in confined spaces, such as a room, the XM104 and M99 release a shower of rubber pellets into the room upon ignition.

Flash bang grenades, however, emit a flash and a loud bang to disorient individuals. The United States Army employs a traditional flash-bang grenade designated the M84 to achieve this effect. The M84 delivers a flash in the order of about 1.5 to about 2.5 million candle power and a bang in the order of about 170 to 180 db within a five foot (about 1.5 meters) radius. A flash bang recently developed by the United States Army with a greater flash intensity and a lower potential for igniting surrounding flammables is disclosed in U.S. Pat. No. 8,161,883 to Harasts et al., issued Apr. 24, 2012 which disclosure is incorporated by reference.

Currently, conventional grenades of each type focus on only a single effect and not on any secondary effect which may be achieved. For example, stun grenades focus on blunt trauma and do not address the effectiveness of the accompanying bright flash or loud bang. A similar issue exists with flash bang grenades. Unfortunately, this requires that a warfighter or law enforcement officer carry and deploy two or more types of grenades.

Additionally, current blunt trauma grenades rely on the ejection of the metal fuze to eliminate the possibility of permanent injury from potentially lethal fragments. The requirement to have the fuze eject without becoming a lethal fragment and remain functional across all operational conditions is a root cause of many issues which reduces the reliability of the grenade and increases the lifecycle unit cost of the grenade. These issues primarily affect safety, producability and reliability, such as the grenade's performance in extreme temperature and/or humidity environments. Current blunt trauma grenades have issues with the seal between the fuze block and the main body. If the seal is too robust, the force needed to eject the fuze is too large and may create a lethal fragment. If the seal is not robust enough, moisture is able to enter the energetic components which may create a dud or allow the fuze block to dislodge during pin removal or rough handling.

Further, a separation charge is needed to eject the fuze thereby complicating the design and increasing the net explosive weight. The two separate pyrotechnic fuzes which are required must function within extremely tight tolerances further complicating the design of the grenade.

Finally, fuze ejection produces a force on the grenade while it is in flight thereby causing the grenade to be diverted away from its course to the intended target while being thrown or launched. Currently, this requires that multiple grenades be launched simultaneously to ensure target effects are reached.

Accordingly, there is a need for an improved non-lethal blunt trauma grenade.

SUMMARY OF INVENTION

The present invention relates to a multipurpose non-lethal blunt trauma grenade.

According to a first aspect of the invention, a non-lethal blunt trauma grenade includes an outer body, a main charge holder housed within the main body, and a fuze coupled to the main charge holder. The main charge holder is configured for housing a main charge and remaining intact after ignition of the main charge. The main charge holder further includes vent openings sized and oriented to balance the propulsive force of gases generated by a main charge such that the main charge holder is not propelled by the main charge.

According to a second aspect of the invention, a non-lethal blunt trauma grenade is configured for producing both a blunt trauma effect and a flash bang effect. The multipurpose non-lethal blunt trauma grenade includes an outer body, a plurality of non-lethal projectiles housed within the outer body, a main charge holder housed within the outer body, and a fuze coupled to the main charge holder. The main charge holder houses a main charge comprising a pyrotechnic mix of about 50 to 55 wt. % strontium nitrate, about 35 to 45 wt. % aluminum powder, about 3 to 6 wt. % sulfur, about 0.5 to about 1.5 wt. % boric acid, and about 0.5% anti-caking agent.

A non-lethal blunt trauma grenade is configured for producing both a blunt trauma effect and a flash bang effect. The multi-purpose non-lethal blunt trauma grenade includes an outer body, a plurality of non-lethal projectiles housed within the outer body, a main charge holder housed within the outer body, and a fuze coupled to the main charge holder. The main charge holder is configured for housing a main charge comprising a pyrotechnic mix of about 50 to 55 wt. % strontium nitrate, about 35 to 45 wt. % aluminum powder, about 3 to 6 wt. % sulfur, about 0.5 to about 1.5 wt. % boric acid, and about 0.5% anti-caking agent. The main charge holder is further configured for remaining intact after ignition of the main charge. The main charge holder includes vent holes extending laterally through the main charge holder at an angle of approximately forty-five degrees from the longitudinal axis of the main charge holder.

BRIEF DESCRIPTION OF THE DRAWINGS

The accompanying figures further illustrate the present invention.

The components in the drawings are not necessarily drawn to scale, emphasis instead being placed upon clearly illustrating the principles of the present invention. In the drawings, like reference numerals designate corresponding parts throughout the several views.

DETAILED DESCRIPTION

The present invention is directed to a multi-purpose non-lethal blunt trauma grenade. The blunt trauma grenade produces multiple effects—blunt trauma, sound and light—in a single device to stun and incapacitate one or more individuals. As such, a user is only required to carry and deploy a single device to achieve these multiple effects rather than multiple grenades with differing payloads.

Further, the blunt trauma grenade eliminates the need for an ejectable fuze by balancing the gas output of a main charge of the grenade to prevent the fuze from becoming a lethal projectile. As such, the grenade overcomes the safety, predictability and reliability issues associated with an ejectable fuze. Namely, the grenade issues related to sealing the ejectable fuze to the main body, including increased failure rate, increased lifecycle cost are reduced. Complexity of operation is also reduced by eliminating the ejection charge and the need to have two independent fuzes function cooperatively. Additionally, by having a fuze that is not ejected prior to ignition of the main charge, a user may more accurately aim the grenade when shooting the grenade from a launch cup during area denial operations.

Figure 1:
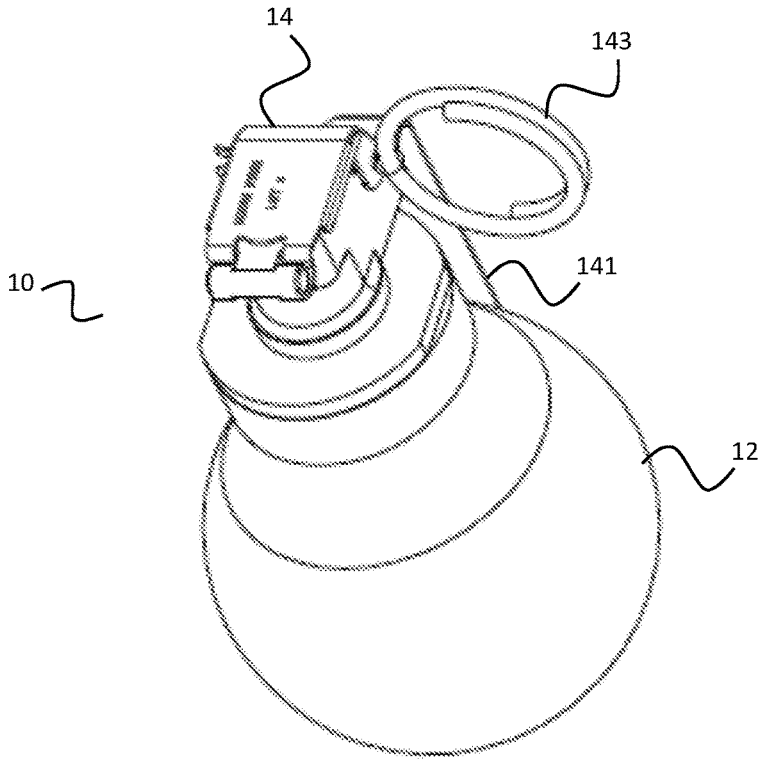
FIG. 1 shows a non-lethal multi-purpose blunt trauma grenade, in accordance with one illustrative embodiment of the invention.

FIG. 1 shows a non-lethal multi-purpose blunt trauma grenade, in accordance with one illustrative embodiment of the invention. The non-lethal multi-purpose blunt trauma grenade 10, hereinafter also referred to as blunt trauma grenade 10 or grenade 10, comprises an outer body 12 connected to a fuze 14. The outer body 12 is hollow and has a generally spherical shape with a cylindrical protrusion at a distal end. An opening in the outer body 12 is defined by a top surface of the cylindrical protrusion. The outer body 12 is composed of a generally light frangible material to ensure that it does not create lethal fragments upon actuation of the grenade 10. For example, in one embodiment the outer body 12 is composed of rubber. In other embodiments, the outer body may be composed of elastomer, plastic, composite, paper, foil or fiber. Because the blunt trauma grenade 10 does not require pressure build-up, as current blunt trauma grenades do, the outer body may be less thick. Accordingly, material costs are reduced and available payload volume is increased. Additionally, the rubber will not harden and turn brittle as in current blunt trauma grenades.

A fuze assembly 14 protrudes through the opening of the outer body. The fuze assembly 14 further comprises a spoon 141. The spoon 141 is restrained from being released by a push pin 143 inserted through the spoon 141. The fuze assembly 14 is configured for delaying the ignition of the main charge 203 for a predetermined period of time. In the embodiment shown in FIG. 1, the fuze assembly 14 is a modified M201A1 type fuze assembly. The M201A1 has a percussion-actuated primer which ignites a delay charge that detonates the main charge 203. In one embodiment, the fuze assembly has a predetermined delay of three seconds. However, the fuze assembly is not limited to a three second delay and may be preset at a time greater than or less than three seconds depending on the required delay for the particular grenade or application.

Figure 2:
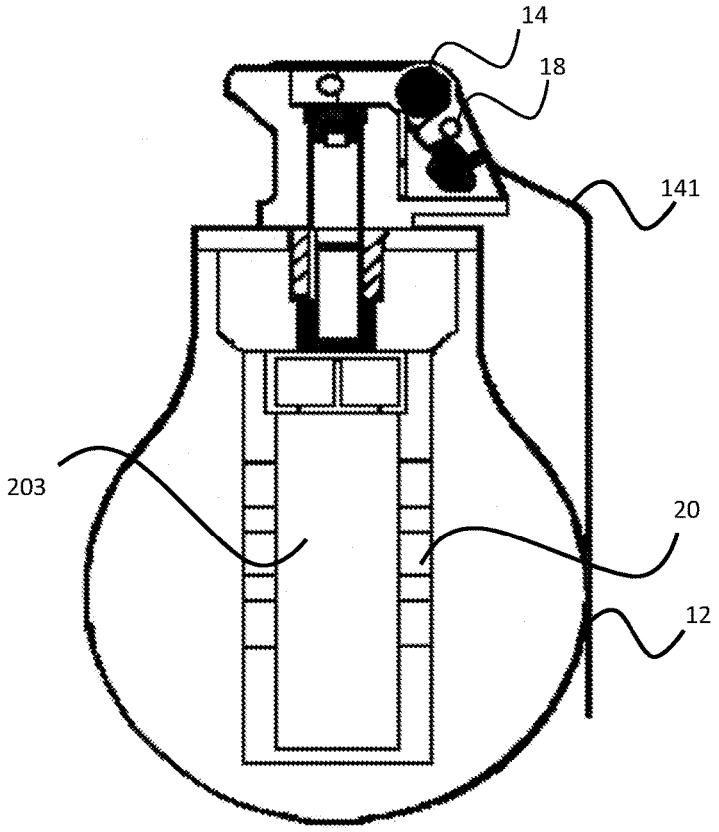
FIG. 2 shows a cross sectional view of the non-lethal multi-purpose blunt trauma grenade, in accordance with one illustrative embodiment of the invention.

FIG. 2 shows a cross sectional view of the non-lethal multi-purpose blunt trauma grenade, in accordance with one illustrative embodiment of the invention. The outer body 12 houses a stinging payload of rubber ball or pellets for delivering the blunt trauma effect. However, the payload is not limited to rubber balls or even a stinging payload. Examples of other payloads include CS gas, dyes, taggants, obscurants, adhesives, sub-munitions, string and fiber. Embodiments of the invention may include some combination of the above payloads in addition to or in place of a stinging payload.

A main charge holder 20 filled with a main pyrotechnic charge is connected to the fuze assembly 14 via a fuze adapter 18 and inserted through opening in the outer body 12. The main charge holder 20, main charge 203 and the fuze adapter 18 sit within the outer body 12.

The fuze adapter 18 securely connects the fuze assembly 14 to the main charge holder 20 and ensures an environmentally controlled seal on all energetic components. The upper end of the charge holder 20, accepts a screwed in plug or fuze adaptor, 18, which on its top face has a conical cavity designed to accept the fuze assembly, 14, and which may provide a path, for the fuse spark to reach the pyrotechnic mix held within the charge holder.

Figure 3:
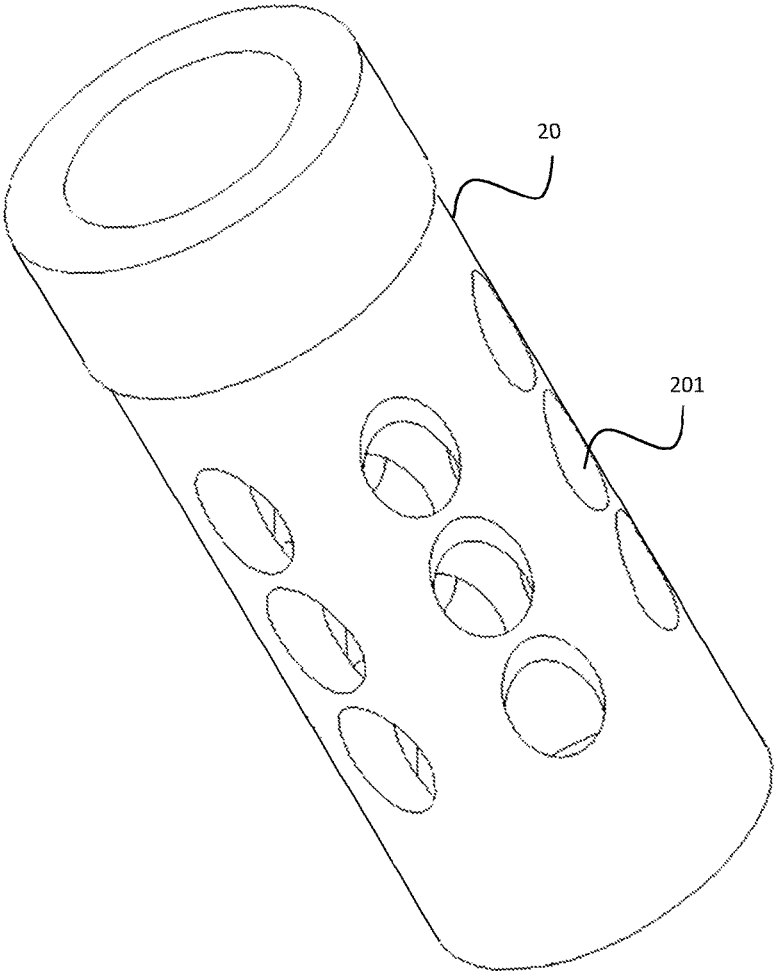
FIG. 3 shows a main charge holder of the non-lethal multi-purpose blunt trauma grenade, in accordance with one illustrative embodiment of the invention.

FIG. 3 shows a cross sectional view of a main charge holder of the non-lethal multi-purpose blunt trauma grenade, in accordance with one illustrative embodiment of the invention. The main charge holder 20 is a cylindrical reaction chamber composed of a rigid material which does not fragment upon ignition of the charge. In an embodiment of the invention, the main charge holder 20 is an anodized aluminum at least 1/10 inch in thickness to provide a relatively rigid, non-fragmenting cylinder. In other embodiments, the main charge holder may be composed of steel, titanium, magnesium composites, some combination thereof or any other material which provides a relatively rigid, non-fragmenting cylinder.

The main charge holder 20 comprises a plurality of vent openings 201 extending laterally through the cylinder walls and sized and dimensioned to balance the propulsive forces of the main charge 20 thereby minimizing the propulsive force on the main charge holder 20 and fuze assembly 14. The explosive gases released during ignition of the main charge 203 are vented through the vent openings 201 such that they are balanced and cause minimal net force of the fuze assembly 14. The vent openings may be of any size, shape and orientation which allows a sufficient volume of propulsive gas to be vented in a direction such that they are balanced. For example, the vent openings may be circular or slit shaped.

In the main charge holder 20 shown in FIG. 3, the vent openings are vent holes 201 which extend from the inner surface of the cylinder to the outer surface of the cylinder in a direction toward the fuze end of the cylinder. The vent holes 201 are at a forty-five degree angle with respect to the central axis of the charge holder. However, the vent holes 201 are not limited to a forty five degree angle from the longitudinal axis of the charge holder. In alternative embodiments, the vent holes 201 may be greater than or less than forty five degrees from the central axis. In an embodiment of the invention, the vent holes are in the range of approximately five to eighty five degrees. Additionally, the orientation of the vent holes 201 may not be uniform among all of the vent holes 201. The size and angle of the vent holes may be increased or decreased to account for the different geometries, materials and explosive compositions used in the blunt trauma grenade 10.

In the embodiment shown in FIG. 3, the main charge holder 20 comprises six groups of three longitudinally aligned vent holes 201, the sets equally spaced about the periphery and centered from the upper and lower ends of the main charge holder 20. The cylindrical charge holder is about 2.25 to about 2.375 inches in overall length with an internal effective charge holding length of about 1.875 inches and has an effective internal charge holding diameter of about ⅝ inch and an overall external diameter of about 1 inch—such that the charge holding capacity of the charge holder is effectively about 0.58 cubic inches. The charge holder 20, preferably has six rows of three vent holes, 201, there through—with each vent hole, 201, being preferably about ¼ inch in diameter and spaced about ⅛ inch apart (in each the row of three). The upper end of the charge holder 20, accepts a screwed in plug or fuze adaptor, 18, which on its top face has a conical cavity designed to accept the fuze assembly, 14, which may contain a separate fuse delay timing mix, and which may provide a path, for the fuse spark to reach the pyrotechnic mix held within the charge holder. The lower end of the charge holder 20, is formed by the closed end of the cylindrical container which forms the charge holder.

The reaction chamber composite has a thin internal or inner sleeve, in the order of about 0.002 to about 0.020 inches thick, preferably from about 0.004 to about 0.009 inches thick, and most preferably from about 0.005 to about 0.006 inches thick—which inner sleeve, is nested within the charge holder 20, a slip fit. Preferably the inner sleeve, is manufactured of aluminum, magnesium or a similar metal, or of a nitrocellulose composite. This thin inner sleeve, is fully consumed by the explosion that results from the ignition of the pyrophoric material housed in the charge holder—adding to the energy of that explosion.

The reaction chamber composite has an outer or external sleeve bonded to form a tight sealed along its longitudinal length—the outer sleeve can be preferably be manufactured of heat shrink tubing (which can be applied by simply placing the external sleeve material over the charge holder 20, and placing the assembly in a 275 degree F. oven for about 20 minutes); a heat shrink tubing with an adhesive lining (e.g. Thomas and Betts HS series, Thomas and Betts Corp., Memphis, Tenn.); heat shrink tubing with thermoset material underneath an elastomeric material, which is shrink fitted about the longitudinal periphery thereof; or, it can be manufactured of a thin aluminum cup/sleeve secured with epoxy (about the same thickness, 0.002 to about 0.020 inches, as the inner sleeve), or a plastic sleeve secured with epoxy, or plastic secured with epoxy or hot melt adhesive. As stated above, the portions of the outer sleeve exposed to the reaction through the vents in the charge holder are consumed by the reaction—just as the inner sleeve is consumed.

In a preferred embodiment of the invention, the main charge is composed of a pyrotechnic formulation mix, which is capable of yielding the desired propulsive force, sound and light emission levels in combination with the physical reaction chamber disclosed and claimed herein. This particular preferred formulation contains, in weight percent, about 50 to about 55%, preferably about 53.5% strontium nitrate oxidizer; about 35 to about 45%, preferably about 40% aluminum powder metallic fuel; about 3 to about 6%, preferably about 5% sulfur non-metallic fuel; and about 0.5% to about 1.5%, preferably about 1% boric acid pH stabilizer; and finally, about 0.5% of a free flow/anti-caking agent, such as, M5 Cab-o-sil free flow/anti-caking agent, available from Cabot Corporation—Becca Golden, Alpharetta Ga. About 8 to about 10 grams, preferably about 9 grams of this strontium nitrate containing formulation are required to provide the desired sound and light properties. Considering the density of this formulation, to accommodate the 8 to 10 gram quantity required, the cylindrical chamber formed by the inner sleeve, 80, would be about ⅝ inches in diameter by about 17/8 inches long.

Ignition of the grenade 10 is initiated by pulling the pin and releasing the spoon by throwing or alternatively launching the grenade 10 toward the desired target. For example, the grenade 10 may be thrown by hand by an operator or may be fired accurately from a Mossberg 500 shotgun manufactured by O.F. Mossberg & Sons of North Haven, Conn. with an associated launch cup. Advantageously, the non-lethal blunt trauma grenade 10 may be fired from a Mossberg 500 shotgun or similar weapon because the fuze assembly 14 is not ejected from the grenade 10 prior to ignition. Once the spoon is released, a striker of the spoon rotates to hit a percussion primer of the fuze assembly 14.

The percussion primer lights a pyrotechnic delay charge of the fuze assembly 14. As discussed above, the fuze assembly 14 may be an M201A1 type fuze assembly modified to provide a desired delay. The delay charge may be set to predetermined delay as required by the application of the grenade 10. For example, in one embodiment of the invention, the M201 fuze assembly 14 is modified to provide an approximately three second delay before ignition of the main charge 203.

The pyrotechnic delay charge burns down until it lights the main charge 203 of the non-lethal blunt trauma grenade 10. This main charge 203 produces enough propulsive gas to break apart the rubber body and expel the rubber balls at speeds sufficient to inflict non-lethal blunt trauma. The main charge 203 additionally produces a bright flash and loud bang which assist in disorienting the target. Using the main charge formulation as described above, the main charge 203 produces a bang and flash of about 180 db measured at 5 feet from the non-lethal blunt trauma grenade 10 and about 13.5 million candela, respectively.

We claim:

1. A non-lethal blunt trauma grenade comprising:
- an outer body;
- a main charge holder housed within the outer body;
- a main charge housed within the main charge holder;
- a fuze assembly coupled to the main charge holder;
- a payload housed within the outer body, for effecting the blunt trauma, the payload configured for being ejected upon ignition of the main charge; and
- wherein the fuze assembly is not ejected from the non-lethal blunt trauma grenade prior to ignition of the main charge and the main charge holder is configured for remaining intact after ignition of the main charge and further comprises a plurality of vent openings sized and oriented to balance the propulsive force of gases generated by the ignition of the main charge such that the main charge holder and fuze assembly are not propelled by the main charge.

2. The non-lethal blunt trauma grenade of claim 1 wherein the plurality of vent openings are angled in a direction toward the fuze assembly.

3. The non-lethal blunt trauma grenade of claim 2 wherein the plurality of vent openings extend laterally through the main charge holder from an inner surface of the charge holder to an outer surface of the charge holder at an angle between approximately five degrees and eighty five degrees with respect to a longitudinal axis of the main charge holder.

4. The non-lethal blunt trauma grenade of claim 3 wherein the plurality of vent openings are vent holes extending laterally through the main charge holder from an inner surface of the charge holder to an outer surface of the charge holder at a forty five degree angle with respect to a longitudinal axis of the main charge holder.

5. The non-lethal blunt trauma grenade of claim 1 wherein the main charge holder is composed of a material from the group comprising aluminum, steel, titanium, magnesium and fiber resin composite.

6. The non-lethal blunt trauma grenade of claim 1 wherein the main charge produces both a blunt trauma effect by ejecting the payload and a flash bang effect.

7. The non-lethal blunt trauma grenade of claim 6 wherein the main charge comprises a pyrotechnic mix of about 50 to 55 wt. % strontium nitrate, about 35 to 45 wt. % aluminum powder, about 3 to 6 wt. % sulfur, about 0.5 to about 1.5 wt. % boric acid, and about 0.5% anti-caking agent.

8. The non-lethal blunt trauma grenade of claim 1 wherein the outer body is composed of a material from the group comprising rubber, elastomer and plastic.

9. A non-lethal blunt trauma grenade configured for producing both a blunt trauma effect and a flash bang effect, the multi-purpose non-lethal blunt trauma grenade comprising:

an outer body;

a plurality of non-lethal projectiles housed within the outer body for effecting the blunt trauma, the plurality of non-lethal projectiles configured for being ejected upon ignition of the main charge;

a main charge holder housed within the outer body configured for housing a main charge;

a main charge comprising a pyrotechnic mix of about 50 to 55 wt. % strontium nitrate, about 35 to 45 wt. % aluminum powder, about 3 to 6 wt. % sulfur, about 0.5 to about 1.5 wt. % boric acid, and about 0.5% anti-caking agent; and a fuze assembly coupled to the main charge holder and further comprising delay charge for igniting the main charge; and wherein the fuze assembly is not ejected from the non-lethal blunt trauma grenade prior to ignition of the main charge and the main charge holder is configured for remaining intact after ignition of the main charge and further comprises a plurality of vent openings sized and oriented to balance the propulsive force of gases generated by the ignition of the main charge such that the main charge holder and fuze assembly are not propelled by the main charge.

10. The non-lethal blunt trauma grenade of claim 9 wherein the plurality of vent holes are angled in a direction toward the fuze assembly.

11. The non-lethal blunt trauma grenade of claim 9 wherein the plurality of vent holes extend laterally through the main charge holder from an inner surface of the charge holder to an outer surface of the charge holder at an angle between approximately five degrees and eighty five degrees with respect to a longitudinal axis of the main charge holder.

12. The non-lethal blunt trauma grenade of claim 9 wherein the main charge holder is composed of aluminum.

13. The non-lethal blunt trauma grenade of claim 9 wherein the outer body is composed of rubber.

* * * * *